US006844514B2

(12) United States Patent
Bach et al.

(10) Patent No.: US 6,844,514 B2
(45) Date of Patent: Jan. 18, 2005

(54) ARC EXTINGUISHER WITH AN ATTACHMENT FOR LOW VOLTAGE SWITCHGEAR

(75) Inventors: Michael Bach, Berlin (DE); Detlev Schmidt, Berlin (DE); Michael Sebekow, Berlin (DE); Günter Seidler-Stahl, Berlin (DE); Ingo Thiede, Berlin (DE); Sezai Türkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/333,255

(22) PCT Filed: Jul. 5, 2001

(86) PCT No.: PCT/DE01/02533

§ 371 (c)(1),
(2), (4) Date: Jun. 30, 2003

(87) PCT Pub. No.: WO02/07175

PCT Pub. Date: Jan. 24, 2002

(65) Prior Publication Data

US 2004/0026377 A1 Feb. 12, 2004

(30) Foreign Application Priority Data

Jul. 18, 2000 (DE) ..... 100 36 370

(51) Int. Cl.[7] ..... H01H 33/02
(52) U.S. Cl. ..... 218/149; 200/306; 335/201
(58) Field of Search ..... 218/153, 157, 218/34, 35, 36, 38–40, 149, 154–158; 335/201, 202

(56) References Cited

U.S. PATENT DOCUMENTS

| | | | | | |
|---|---|---|---|---|---|
| 3,582,966 | A | * | 6/1971 | Strobel | 218/149 |
| 3,621,169 | A | * | 11/1971 | Eldon et al. | 218/152 |
| 3,803,376 | A | * | 4/1974 | Cryctko | 218/149 |
| 4,388,506 | A | | 6/1983 | Murai et al. | |
| 4,876,424 | A | * | 10/1989 | Leone et al. | 200/306 |
| 5,756,951 | A | * | 5/1998 | Manthe et al. | 218/35 |
| 6,222,146 | B1 | * | 4/2001 | Turkmen | 218/149 |

FOREIGN PATENT DOCUMENTS

| | | |
|---|---|---|
| DE | 3541514 A | 5/1987 |
| DE | 4410108 A1 | 5/1998 |
| EP | 0437151 A1 | 7/1991 |
| EP | 0437151 B1 | 7/1991 |

* cited by examiner

*Primary Examiner*—Elvin Enad
*Assistant Examiner*—M. Fishman
(74) *Attorney, Agent, or Firm*—Dickey & Pierce, P.L.C.

(57) ABSTRACT

An arc extinguisher for low voltage switchgear, switching in air, includes a universally applicable variable attachment for adjustment of the arc extinguisher chamber to meet increased demands. The attachment is in the form of a chimney-like arc extinguisher chamber extension, for increasing the volume of the arc extinguisher chamber. It represents a moulded piece with a lower outline which exactly matches the outline of the arc extinguisher chamber cover, normally located on the arc extinguisher chamber and with an upper outline, identical to the upper outline of the switchgear housing for mounting the arc extinguisher chamber cover. Any number of attachments may be used in a stacked manner.

24 Claims, 3 Drawing Sheets

ARC EXTINGUISHER WITH AN ATTACHMENT FOR LOW VOLTAGE SWITCHGEAR

This application is the national phase under 35 U.S.C. § 371 of PCT International Application No. PCT/DE01/02533 which has an International filing date of Jul. 5, 2001, which designated the United States of America and which claims priority on German Patent Application number DE 100 36 370.9 filed Jul. 18, 2000, the entire contents of which are hereby incorporated herein by reference.

FIELD OF THE INVENTION

The invention generally relates to an arc quenching device for a low-voltage switching device which switches in air. Preferably, it relates to one having a universally usable, variable attachment for matching the arc quenching chamber to more stringent requirements.

BACKGROUND OF THE INVENTION

Low-voltage circuit breakers which switch in air require an arc quenching device for operation, in order to quench arcs that occur without any adverse effect on the circuit breaker itself or on adjacent system parts or other assemblies. This is because if this is not done, there is a risk of the hot and hence ionized arc gases causing electrical flashovers, injuring operators, or causing other damage.

Two fundamentally different physical forms are known for the conventional arc quenching devices for low-voltage circuit breakers. In large circuit breakers, until now, complete quenching chambers, which are essentially conventionally produced separately as a component, that is to say a robust enclosure which is resistant to arcs, pressure and temperature and has arc splitters located in it, and a suitable blowing apparatus have until now been fitted to the circuit breaker. One quenching chamber is generally provided for each pole. This chamber has a complete enclosure whose strength is matched not only to the mechanical forces but also to the electrical forces of the arc which occurs in it and is to be quenched, in particular with regard to the pressure and the temperature of the switching gases. The arc splitters are located in this chamber. The chamber may in this case be in the form of a pot-like shaft in which the splitter plates are inserted, or in the form of a structure composed of half shells in which an apparatus is required in order firstly to insert the splitter plates into one half shell, then to fit the second half shell, and finally to connect the two half shells.

Quenching chamber inserts are used as a second form, in which only the function of actual arc quenching can be achieved in one unit. However, this design is not able to withstand the pressure which occurs in conjunction with the arc. These inserts are therefore inserted into a shaft which is provided in or on the switch enclosure. Until now, this form has been predominantly used for small compact circuit breakers, but is also increasingly being used for relatively large circuit breakers, where the enclosures surround these areas, that is to say the switching area and the quenching area.

In these modern low-voltage circuit breakers, the arc quenching chambers are integrated in the enclosure of the switch. The quenching chambers therefore do not form an object projecting beyond the contour of the switch. Although, as before, they are autonomous objects for large circuit breakers, they are, however, included in the overall design such that they end flush with the enclosure contours and only the outlet openings are still visible. However, the parts are accessible and can be removed in order, for example, to assess the contacts located underneath them. If necessary, the entire quenching chamber can also be replaced.

In certain types of even relatively large low-voltage circuit breakers, which are referred to by the American expression ICCB (insulated case circuit breaker), such a design has already been chosen in which prefabricated arc splitter stacks are inserted into the switch enclosure. However, this results in a secondary problem. The insertion of the arc splitter stack does not yet in itself complete the arc quenching device as an entity since, in the end, the switching gases have to leave the switch and emerge into free space without being able to cause any damage.

In conventional circuit breakers, outlet openings are provided for this purpose in the enclosure, which are a component of the enclosure, for example a perforated wall in the enclosure or a wire grating inserted into a retaining opening in the enclosure. This is necessary since, after passing through the arc splitter stack, the switching gasses have not yet been sufficiently cooled down to allow them to emerge into free space. The gas is hot and ionized, and this can lead to flashovers to grounded parts or between busbars. The hot switching gases may also cause sparks and can endanger or injure operators. In consequence, further cooling is essential. Further chamber attachments have therefore been created. For example, DE-A 35 41 514 and 44 10 108 disclose a completely autonomous structure, although based on conventional arc quenching chambers, with enclosure bodies and arc splitters arranged in them, with damping apparatuses fitted to the quenching chambers in order to further cool the switching gases, which are still too hot having passed through the splitter plates, with the damping apparatus that is proposed in DE A 44 10 108 being in the form of an isolating fitted chamber cover, and DE A 35 41 514 indicating a solution in which the attachment contains a number of perforated inserts which are held by means of a covering element through which attachment elements pass. This attachment is highly complex in terms of design and manufacture and has only a partial influence on the characteristics.

A damping insert that is provided also requires a specific pressure response. The gases must emerge unimpeded from the arc splitter area and must then be trapped in a temporary storage area from which, in the end, they can emerge into free space, after having been cooled down.

There are situations in which this solution is not adequate either. EP PS 0437151 B1 discloses a multiple low-voltage circuit breaker in a dielectric enclosure which is equipped with a duplicated cooling apparatus for the quenching gases and is subdivided by dielectric intermediate walls into a number of internal compartments, each of which is associated with one of the poles. In this case, each switching pole has an associated arc splitter stack for deionization of the arc that is struck when the contacts are disconnected, as well as an outlet opening, which is fitted with a first gas cooling apparatus, for the switching gases. These outlet openings then open into a further chamber, which is shared by all the switch poles and has a second cooling apparatus, after passing through which the switching gases are dissipated through gas outlet openings into the surrounding medium. The gases, which are still very hot and are still highly ionized, meet one another before the second cooling apparatus, which can lead to disadvantages.

None of the cited solutions have any damping or blowing devices which themselves belong to only a single arc quenching chamber. They thus represent a comparatively high level of complexity both with regard to the amount of material and with regard to the extent of assembly work. Furthermore, they do not allow the use of uncomplicated material-saving quenching chamber designs, since these do not sufficiently damp and cool down the emerging switching gases.

Furthermore, they do not effectively prevent the still hot, ionized switching gases from entering areas of the switchgear assembly in which they can cause damage. For this reason, known circuit breakers are then subject either to a restricted voltage range or, as described, additional parts such as chimneys or attachments with deionizing media are used. This may be the situation when an increased short-circuit switching capacity is required or a higher rated voltage, for example a higher short-circuit current, since this in general leads to the quenching chamber having to have a larger volume because these parameters affect the design of the quenching chamber, for example the number of arc splitters, the length of the distance which the arc can travel on the arc splitters, the nature of the insulation, damping or deionization at the output of the quenching chamber, and other features.

The chimneys or attachments which have been mentioned are, however, always designed for only one specific situation and cannot be used, extended, varied, interchanged or replaced universally.

SUMMARY OF THE INVENTION

An object of an embodiment of the invention is therefore to provide an arc quenching device having a variable attachment which can be used universally in accordance with the normal present-day constructional ideas. By this, arc quenching chambers can be matched to more stringent requirements without any need to additionally construct corresponding quenching chambers.

According to an embodiment of the present invention, this object may be achieved by an arc quenching device having an attachment for low-voltage switching devices. The attachment is in the form of a chimney-like arc quenching chamber extension in order to increase the volume of the arc quenching chamber. It represents a molding which has a lower contour which is precisely the same as the contour of the arc quenching chamber cover which is normally located on the arc quenching chamber, and whose upper contour is identical to the upper contour of the enclosure in order to accommodate the arc quenching chamber cover. The arc quenching chamber is thus used without the standard cover. Instead of the cover, a molding is first of all fitted as an extension to the arc quenching chamber, and to which the arc quenching chamber cover is now fitted. One or more further moldings may also be provided in advance, before the arc quenching chamber cover is fitted as a closure. A molding in this case enlarges the chamber volume by a specific additional volume.

The configuration of the lower contour of the molding such that it is identical to the contour of the arc quenching chamber cover and the embodiment of the upper contour of the molding such that it is identical to the upper contour of the enclosure for holding the arc quenching chamber cover allows any desired number of moldings to be stacked thus allowing the volume of the arc quenching chamber to be enlarged by a multiple of the additional volume in order to comply with the technical requirements, to be precise simply by forming a stack of moldings. The switching capacity can thus be increased in a simple manner.

The material of the molding is expediently identical to the material of the arc quenching chamber cover.

The special contours of the enclosure, attachment and arc quenching chamber cover result in labyrinths which provide a seal for the switching gases and provide safe phase isolation even in the event of short circuits.

The attachment or the attachments is or are attached by use of a screw of appropriate length to the identical attachment point as the arc quenching chamber cover. Further, as described above, the have the insertion/latching mechanism, which is typical for such covers, for mechanical coupling between the switch enclosure and the arc quenching chamber cover. The attachments may expediently have different heights in the form of sets, thus allowing the enlargement of the arc quenching chamber to be matched to the requirements in steps.

BRIEF DESCRIPTION OF THE DRAWINGS

To assist understanding, the invention will be explained in more detail in the following text with reference to a preferred exemplary embodiment, although this does not restrict the scope of protection.

DETAILED DESCRIPTION OF THE PREFERRED EMBODIMENTS

Figure 1:
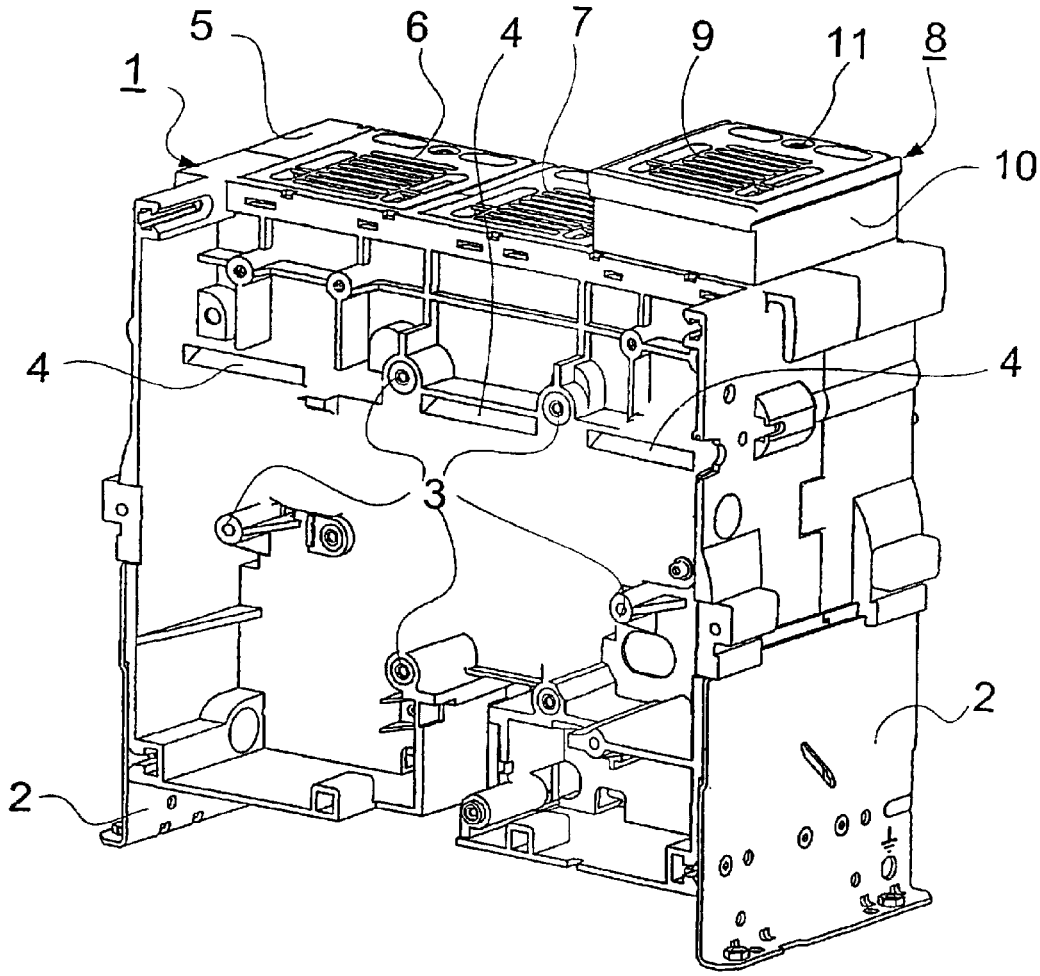
FIG. 1 shows a low-voltage circuit breaker in which the control panel and the drive parts are omitted, in the form of a perspective view, seen from the front face of the switch.

FIG. 1 shows a low-voltage circuit breaker 1 with foot plates 2, from which, in order to improve the clarity, the control panel and the drive parts have been omitted, since they are not significant to the description of embodiments of the invention. Only the threaded bushes 3 for the attachment screws which are required to attach them can be seen, and the through-openings 4 for the switching linkage for the three switching poles. In order to make an embodiment of the invention clear, two quenching chambers are illustrated in the normal state for exemplary purposes. That is to say only those quenching chamber covers 6; 7 which end flush with the top face 5 of the low-voltage circuit breaker 1 can be seen.

An attachment 8 according to an embodiment of the invention and having a quenching chamber cover 9 is arranged on the third arc quenching chamber. The attachment is in the form of an arc quenching chamber extension in order to enlarge the volume of the quenching chamber, and represents a molding 10 whose lower contour 16 precisely matches the contour of the holder for the arc quenching chamber cover which is normally located on the arc quenching chamber. The upper contour of the molding 10 is identical to the upper contour of the enclosure for holding the arc quenching chamber cover 6; 7; 9. Thus, instead of the arc quenching chamber cover 6; 7; 9, a molding 10 is first of all fitted to the arc quenching chamber as an extension to the arc quenching chamber, and the arc quenching chamber cover 6; 7; 9 is now fitted to this. A further molding 10 or a number of further moldings can now also be provided in advance, which are then covered by the arc quenching chamber cover 9. The attachment 10, or the attachments 10, is or are attached by a screw of appropriate length to the identical attachment point 11 as the arc quenching chamber cover.

Figure 2:
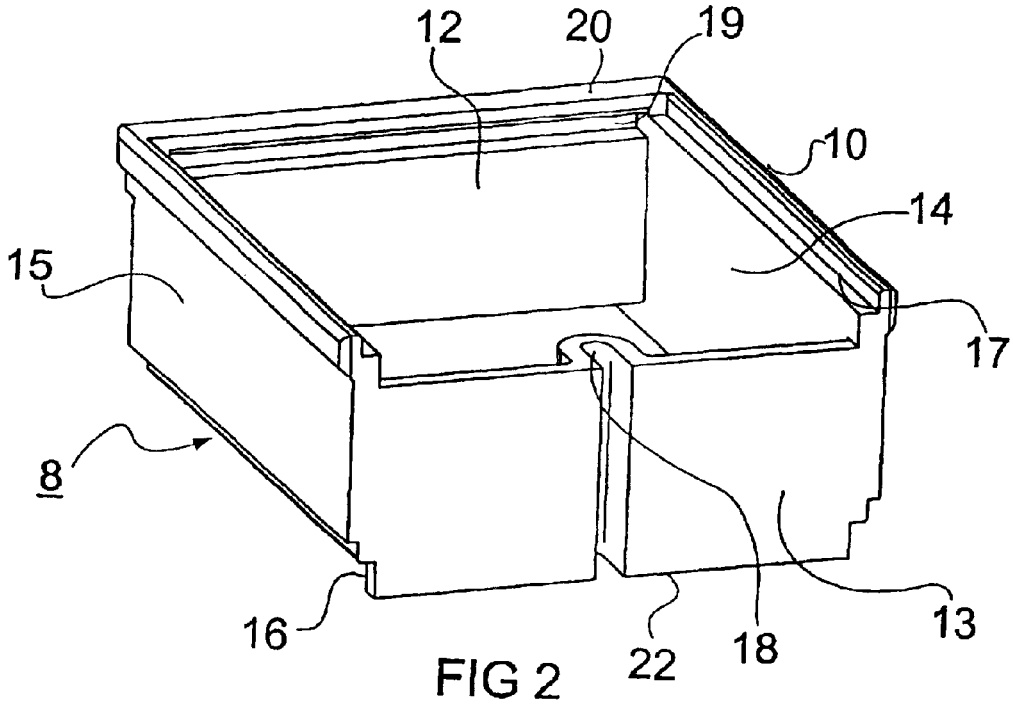
FIG. 2 shows an attachment according to an embodiment of the invention, in the form of a perspective illustration, seen from the side of the attachment screw.
Figure 3:
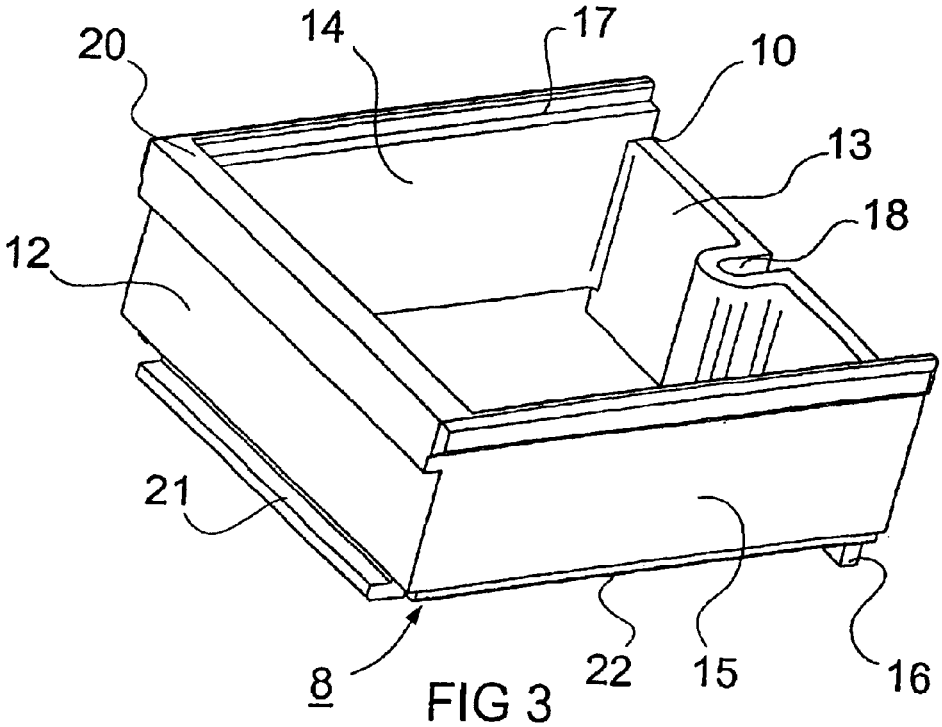
FIG. 3 shows the same attachment, in the form of a perspective view, seen from the opposite side.

FIGS. 2 and 3 show an attachment 8 according to an embodiment of the invention in the form of a perspective illustration, seen from different sides. The attachment 8 is in the form of a molding 10 with a front wall 12, a rear wall 13, a first side wall 14 and a second side wall 15. It has a lower contour 16 which is precisely the same as the contour of the arc quenching chamber cover 6; 7; 9 which is normally located on the arc quenching chamber, and whose upper contour 17 is identical to the upper contour of the switch enclosure in order to hold the arc quenching chamber cover 6; 7; 9 in the normal way. An indentation 18 is provided in the rear wall 13, through which the attachment screw is passed, whose length is chosen appropriately to match the number of attachments 8 that are used.

As described above, the attachment 8 has the insertion/latching mechanism, which is typical for such covers, for mechanical coupling between the switch enclosure and the arc quenching chamber cover 6; 7; 9, in this case represented by a groove 19 on the top face 20 and by a projection 21. The mechanism engages in this groove when it is being fitted, on the lower face 22 of the attachment 8.

Figure 4:
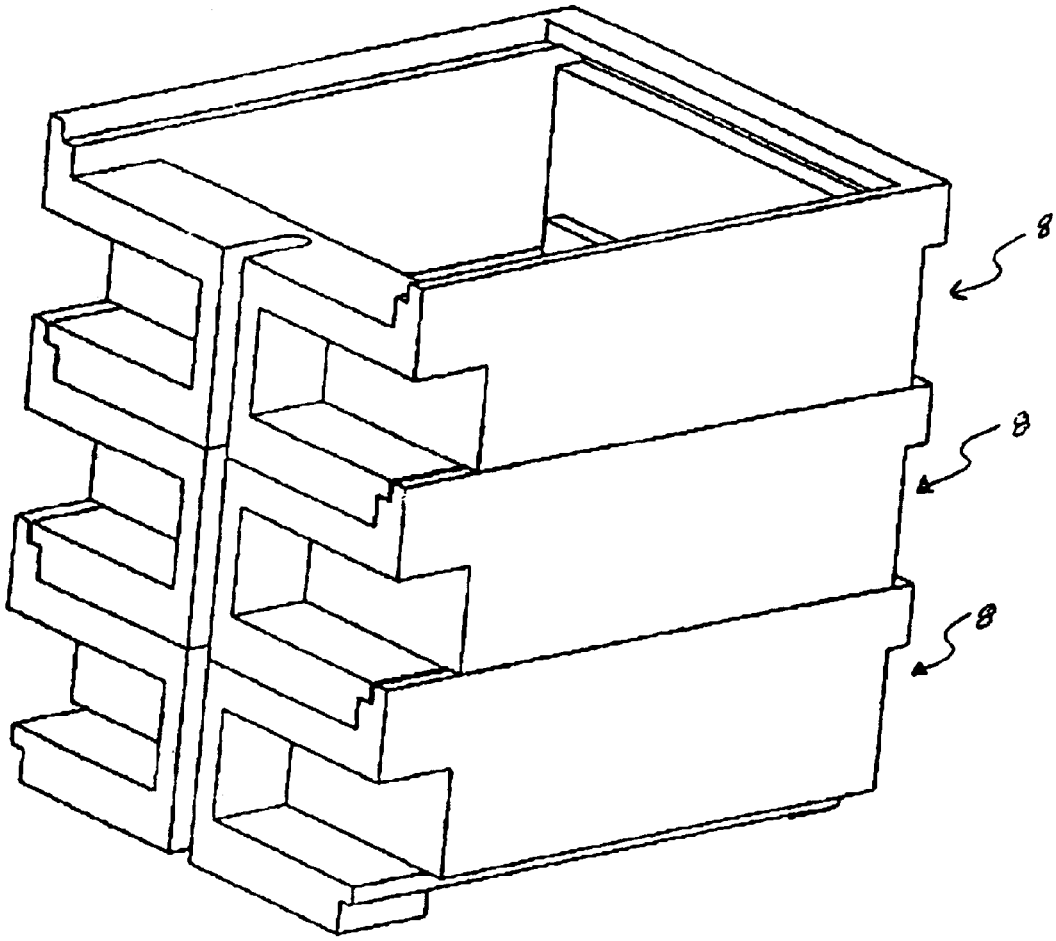
FIG. 4 shows a plurality of attachments arranged in a stack.

Once the attachment 8 has been fitted to the switch enclosure or to a further attachment 8 that is already present, the arrangement is fixed by use of an attachment screw. The screw is passed through the indentation 18, with the special contours of the enclosure, attachment and arc quenching chamber cover producing labyrinths which provide a seal for the switching gases and ensure safe phase isolation even in the event of short circuits. Any desired number of modular attachments 8 can be stacked one on top of the other in this way (e.g. see FIG. 4).

An embodiment of the invention provides an arc quenching device having a variable attachment which can be used universally in accordance with the normal present-day construction ideas, by which are quenching chambers can be matched to more stringent requirements without any need to construct corresponding quenching chambers in addition.

List of reference symbols

1 Low-voltage circuit breaker
2 Foot plate
3 Threaded bushes
4 Through-opening
5 Top face
6 Quenching chamber cover
7 Quenching chamber cover
8 Attachment part
9 Quenching chamber cover
10 Molding
11 Attachment point
12 Front wall
13 Rear wall
14 First side wall
15 Second side wall
16 Lower contour
17 Upper contour
18 Indentation
19 Groove
20 Top face
21 Projection
22 Lower face The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arc quenching device for a low-voltage switching device which switches in air, comprising:

a universally usable attachment, wherein the attachment is in the form of an arc quenching chamber extension to increase the volume of an arc quenching chamber, and wherein the attachment represents a molding which has a lower contour which is the same as the contour of an arc quenching chamber cover which is locatable on the arc quenching chamber, and an upper contour that is identical to the upper contour of the arc quenching chamber to accommodate the arc quenching chamber cover.

2. The arc quenching device as claimed in claim 1, wherein any desired number of moldings are stackable by virtue of the shape of their lower and upper contours.

3. The arc quenching device as claimed in claim 1, wherein the material of the molding is identical to the material of the arc quenching chamber cover.

4. The arc quenching device as claimed in claim 1, wherein the matched contours of the arc quenching chamber, attachment and arc quenching chamber cover form labyrinths which provide a seal for switching gases.

5. The arc quenching device as claimed in claim 1, wherein the upper and lower contours of the attachment are identical to a mechanism for mechanical coupling between the arc quenching chamber and the arc quenching chamber cover.

6. The arc quenching device as claimed in claim 1, wherein at least one attachment is attached via a screw of appropriate length to an identical attachment point as the arc quenching chamber covers.

7. The arc quenching device as claimed in claim 1, wherein a plurality of attachments having different heights are included for enlarging the arc quenching chamber.

8. The arc quenching device as claimed in claim 1, wherein a plurality of attachments are attached via a screw of appropriate length to a identical attachment point as the arc quenching chamber covers.

9. The arc quenching device as claimed in claim 8, wherein the plurality of attachments have different heights.

10. The arc quenching device as claimed in claim 2, wherein the material of the molding is identical to the material of the arc quenching chamber cover.

11. An arc quenching device for a low-voltage switching device, comprising:

an attachment, including an arc quenching chamber extension to increase volume of an arc quenching chamber, the attachment including a first contour matching the contour of an arc quenching chamber cover, and a second contour matching the upper contour of the arc quenching chamber to accommodate the arc quenching chamber cover.

12. The arc quenching device as claimed in claim 11, wherein a plurality of stackable attachments are included.

13. The arc quenching device as claimed in claim 11, wherein the material of the attachment is identical to the material of the arc quenching chamber cover.

14. The arc quenching device as claimed in claim 11, wherein the matched contours of the arc quenching chamber, attachment and arc quenching chamber cover form labyrinths which provide a seal for switching gases.

15. The arc quenching device as claimed in claim 11, wherein the upper and lower contours of the attachment are identical to a mechanism for mechanical coupling between the arc quenching chamber and the arc quenching chamber cover.

16. The arc quenching device as claimed in claim 11, wherein at least one attachment is attached via a screw of appropriate length to an identical attachment point as the arc quenching chamber covers.

17. The arc quenching device as claimed in claim 11, wherein a plurality of attachments having different heights are included for enlarging the arc quenching chamber.

18. An attachment for an arc quenching device of a low-voltage switching device, the attachment comprising:

an arc quenching chamber extension to increase volume of an arc quenching chamber;

a relatively lower contour matching the contour of an arc quenching chamber cover; and a relatively upper contour matching the upper contour of the arc quenching chamber to accommodate the arc quenching chamber cover.

19. The attachment as claimed in claim 18, wherein the attachment is stackable with other attachments.

20. The attachment as claimed in claim 18, wherein the material of the attachment is identical to the material of the arc quenching chamber cover.

21. The attachment as claimed in claim 18, wherein the matched contours of the arc quenching chamber, attachment and arc quenching chamber cover form labyrinths which provide a seal for switching gases.

22. The attachment as claimed in claim 18, wherein the upper and lower contours of the attachment are identical to a mechanism for mechanical coupling between the arc quenching chamber and the arc quenching chamber cover.

23. The attachment as claimed in claim 18, wherein at least one attachment is attached via a screw of appropriate length to an identical attachment point as the arc quenching chamber covers.

24. The attachment as claimed in claim 18, wherein attachments may be of different heights for enlarging the arc quenching chamber.

* * * * *